US006691907B1

(12) United States Patent
Chang

(10) Patent No.: US 6,691,907 B1
(45) Date of Patent: Feb. 17, 2004

(54) COMBINATION OF SAFETY ASSEMBLY AND TRIGGER ASSEMBLY FOR STAPLE GUNS

(76) Inventor: Wen-Chou Chang, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/463,970

(22) Filed: Jun. 17, 2003

(30) Foreign Application Priority Data

Dec. 26, 2002 (TW) ..... 91221729 U

(51) Int. Cl.[7] ..... B25C 1/04
(52) U.S. Cl. ..... 227/8; 227/130
(58) Field of Search ..... 227/8, 130, 10, 227/9, 2; 123/46 SC

(56) References Cited

U.S. PATENT DOCUMENTS 5,687,899 A * 11/1997 Dohi et al. ..... 227/10
5,881,941 A * 3/1999 Lai ..... 227/130
6,223,966 B1 * 5/2001 Nayrac et al. ..... 227/130
6,382,492 B1 * 5/2002 Moorman et al. ..... 227/180
6,431,425 B1 * 8/2002 Moorman et al. ..... 227/2
6,431,429 B1 * 8/2002 Canlas et al. ..... 227/130
6,533,156 B1 * 3/2003 Chang ..... 227/8
6,604,664 B2 * 8/2003 Robinson ..... 227/130

* cited by examiner

*Primary Examiner*—Scott A. Smith
(74) *Attorney, Agent, or Firm*—Charles E. Baxley

(57) ABSTRACT

A combination of a safety tube and a trigger assembly of a staple gun. The safety tube is movably connected to a distal end of the nose of the gun and electrically connected to an electromagnetic valve on the handle. The valve has a shaft movably seals an opening in communication with the main passage in the handle. A trigger assembly which is a button electrically connected to the valve. The safety tube is pushed against the object and activates the valve to seal a path which leads pressurized air to a space between the end cap and the end mount assembly, the button is pushed to move the end cap from the open end of the cylinder so as to eject a staple from the nose. The arrangement of the safety tube and trigger assembly allow the staple gun to have more linear and smooth outer contour.

8 Claims, 13 Drawing Sheets

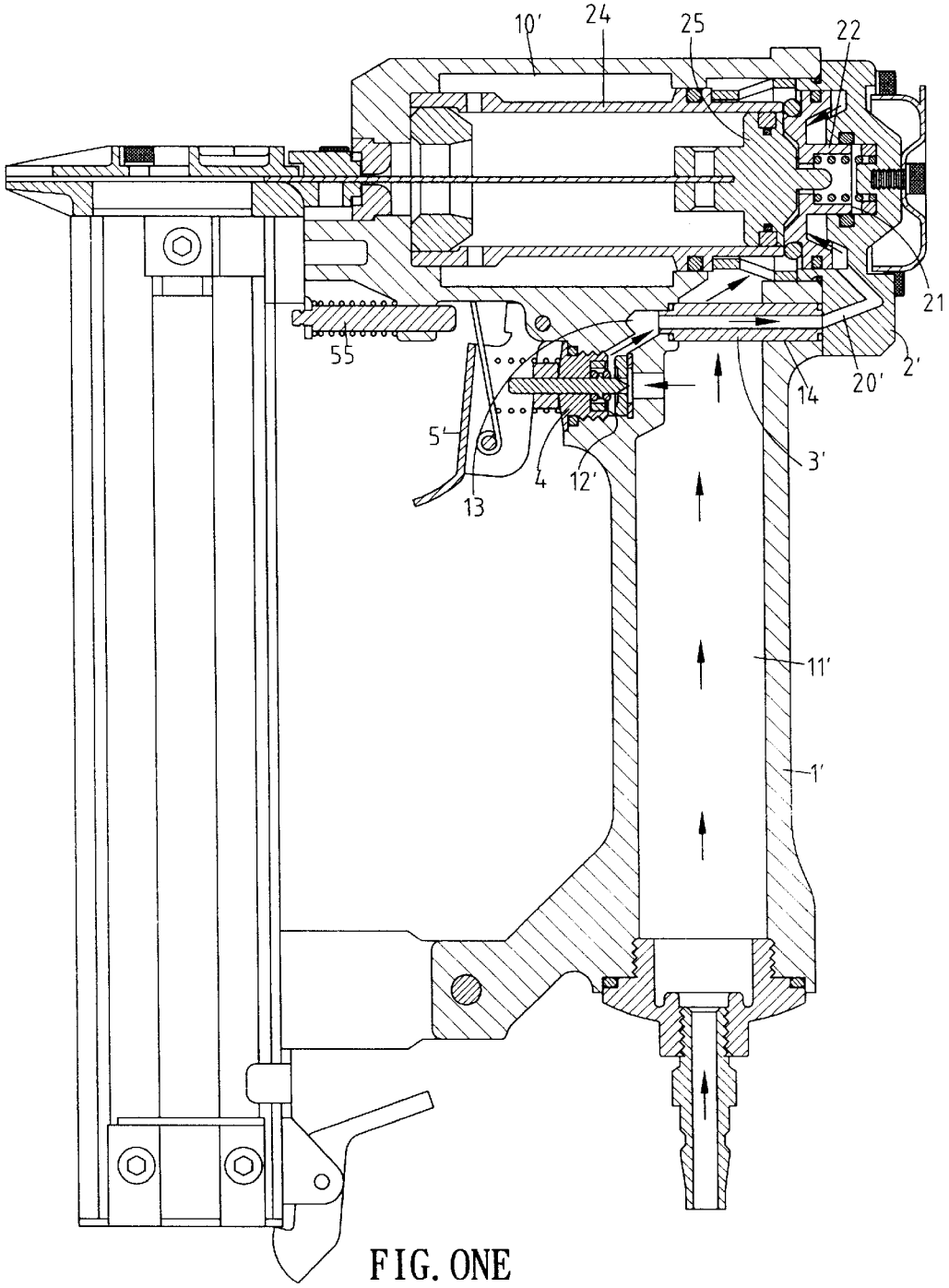
FIG. ONE
PRIOR ART

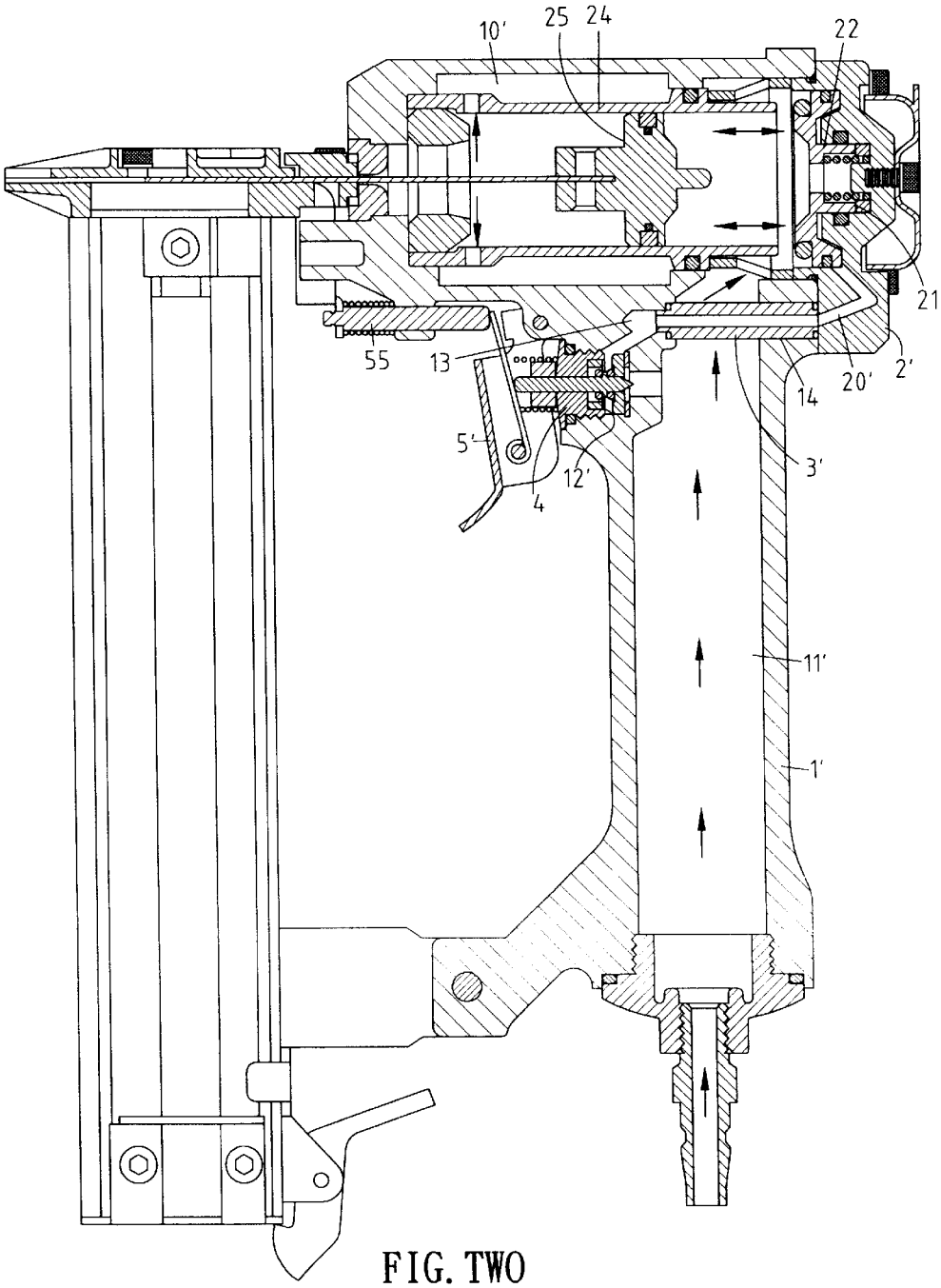
FIG. TWO
PRIOR ART

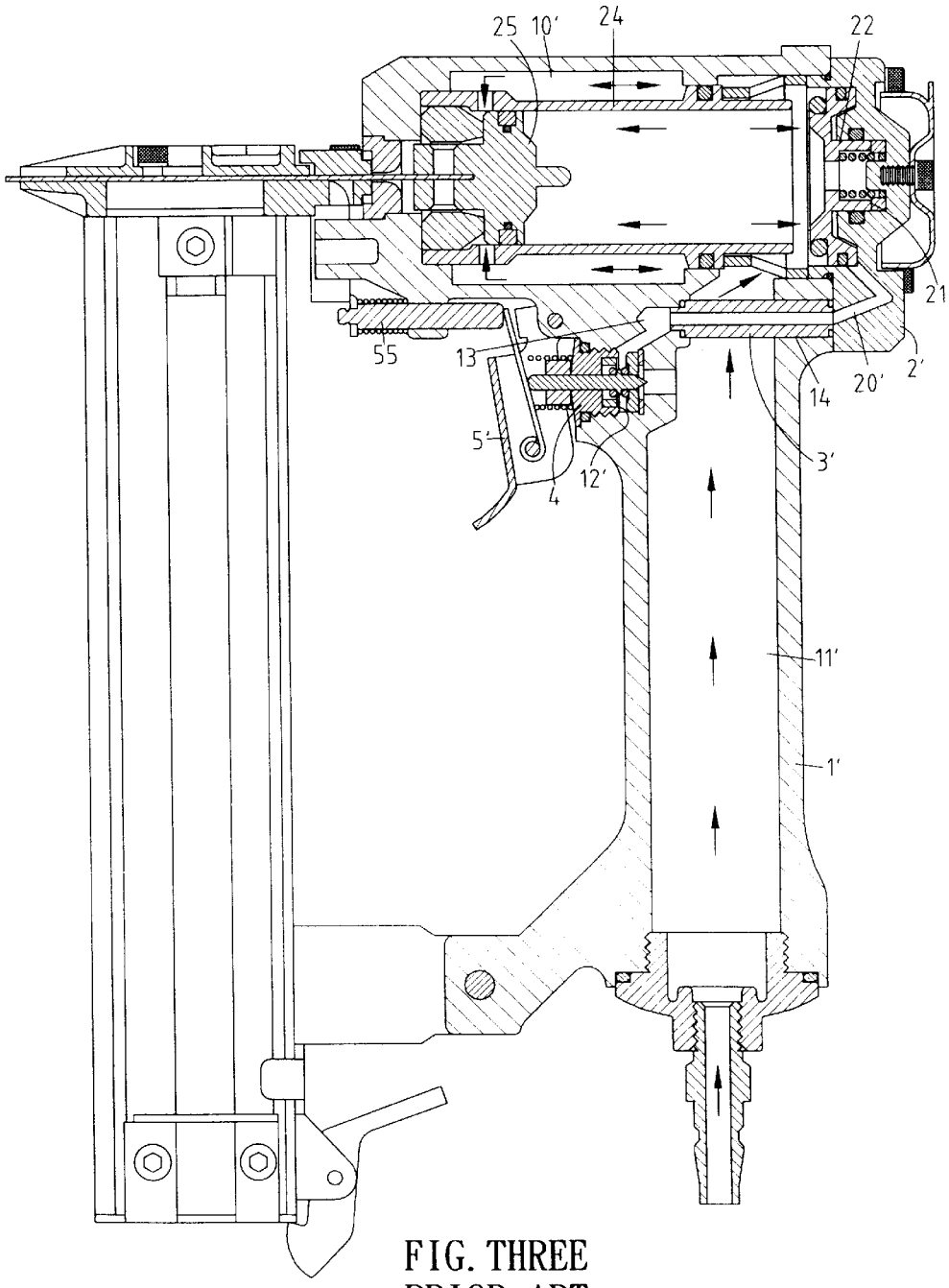
FIG. THREE
PRIOR ART

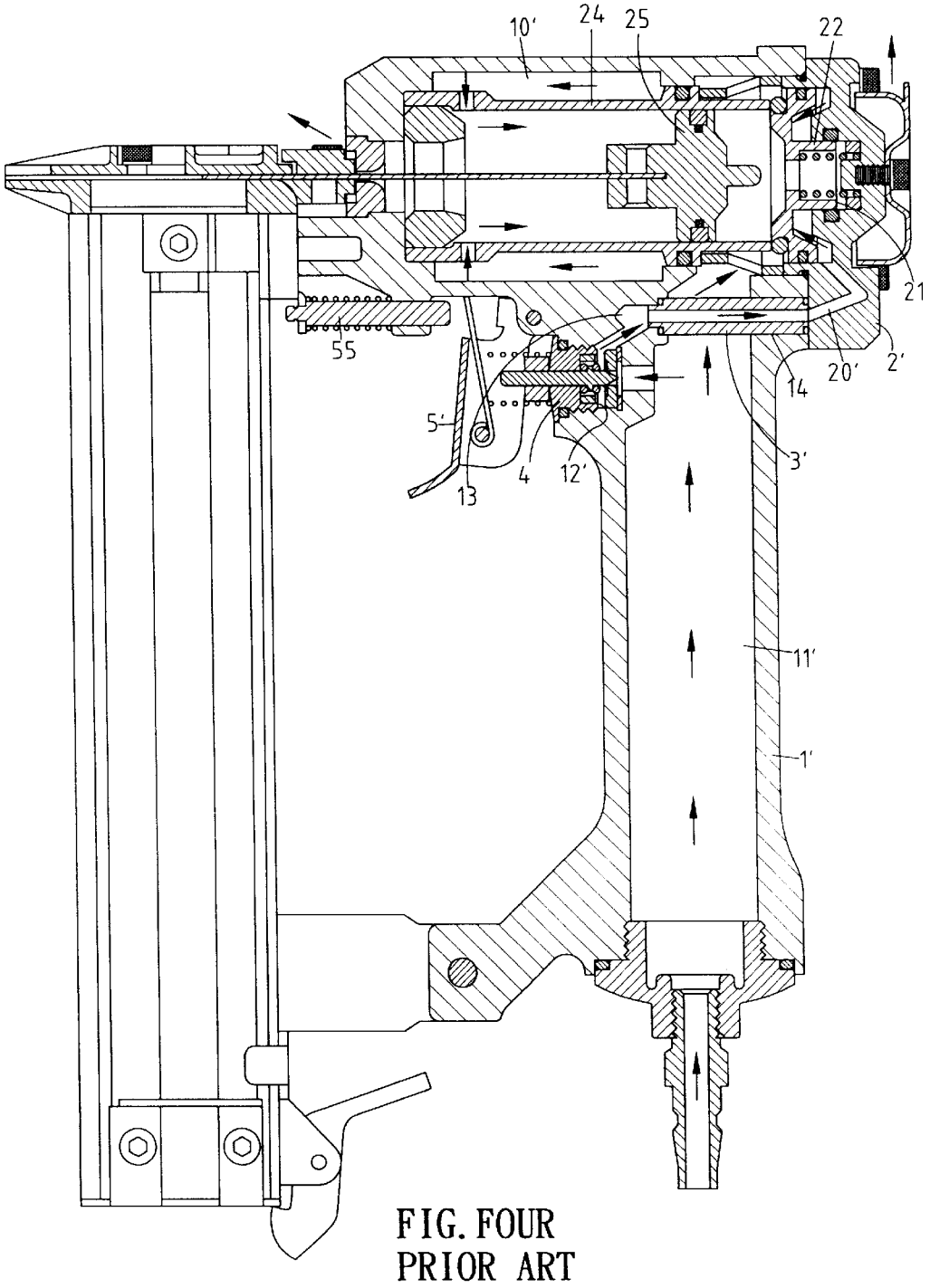
FIG. FOUR
PRIOR ART

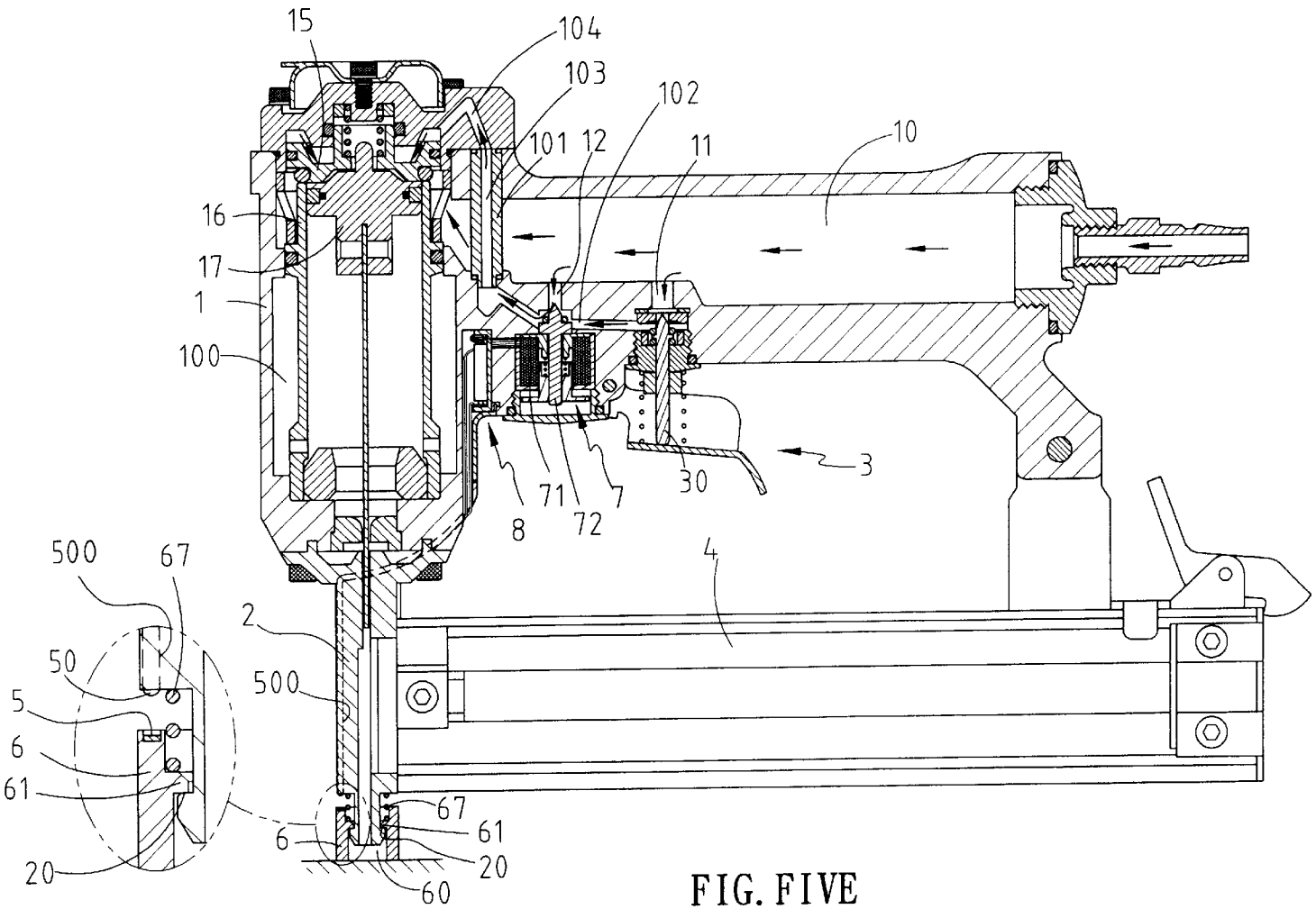
FIG. FIVE

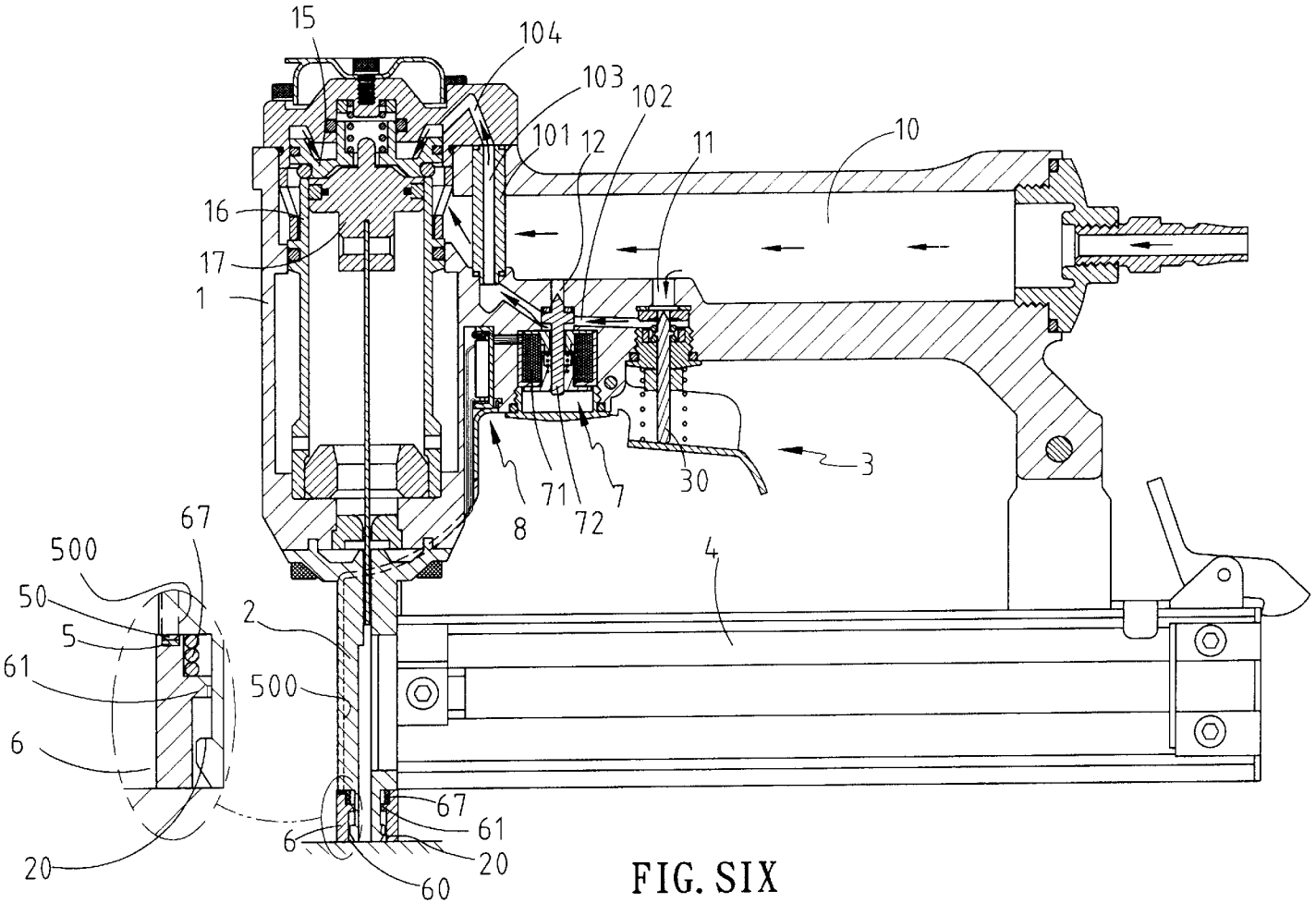
FIG. SIX

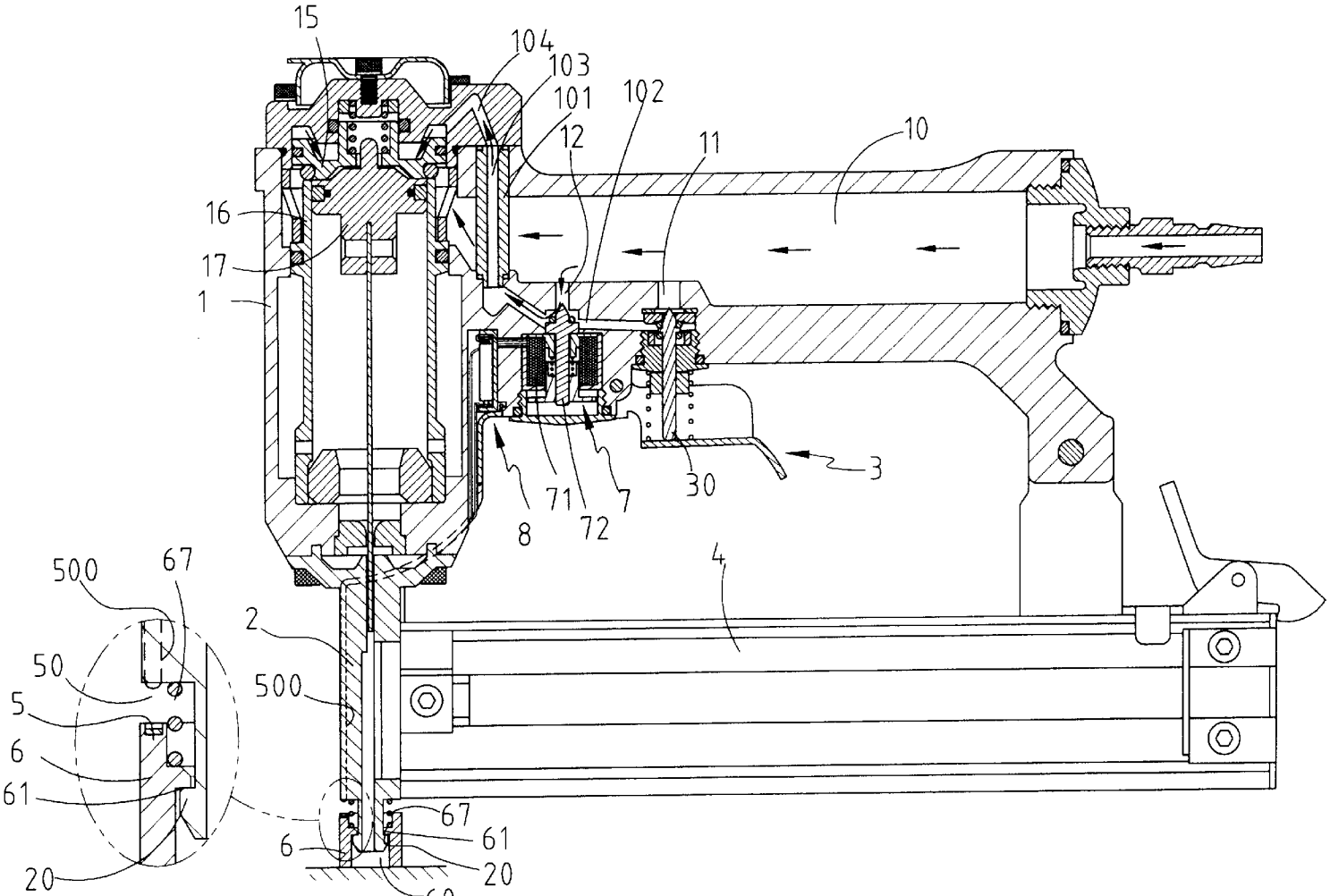
FIG. SEVEN

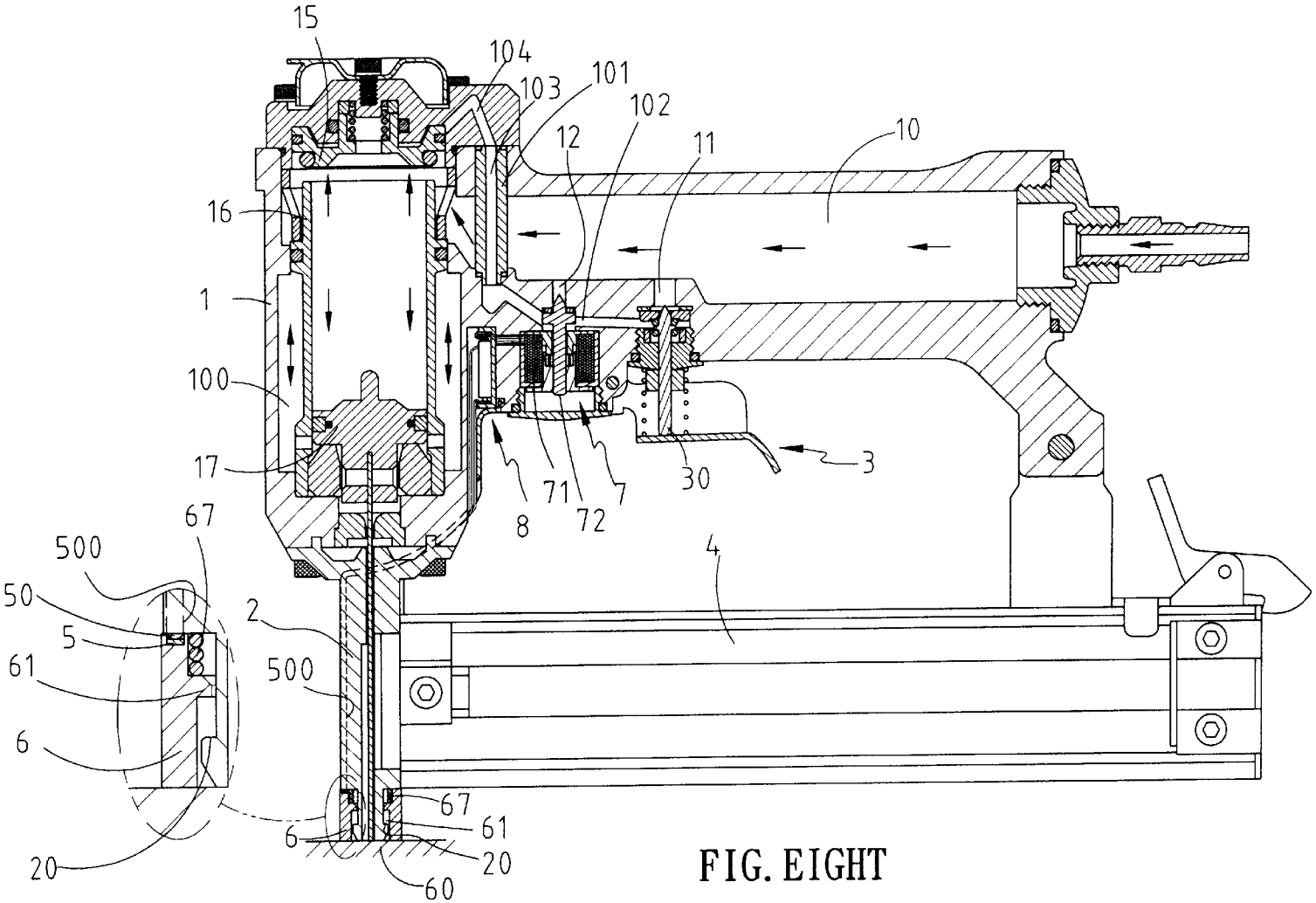
FIG. EIGHT

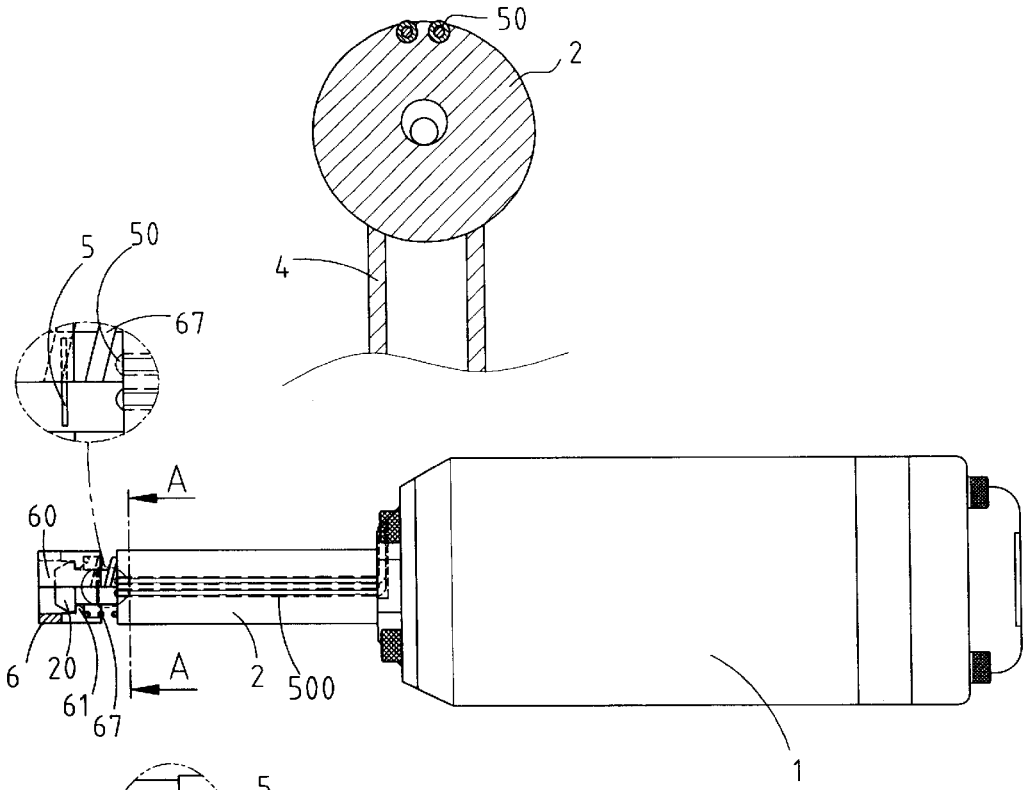
FIG. NINE
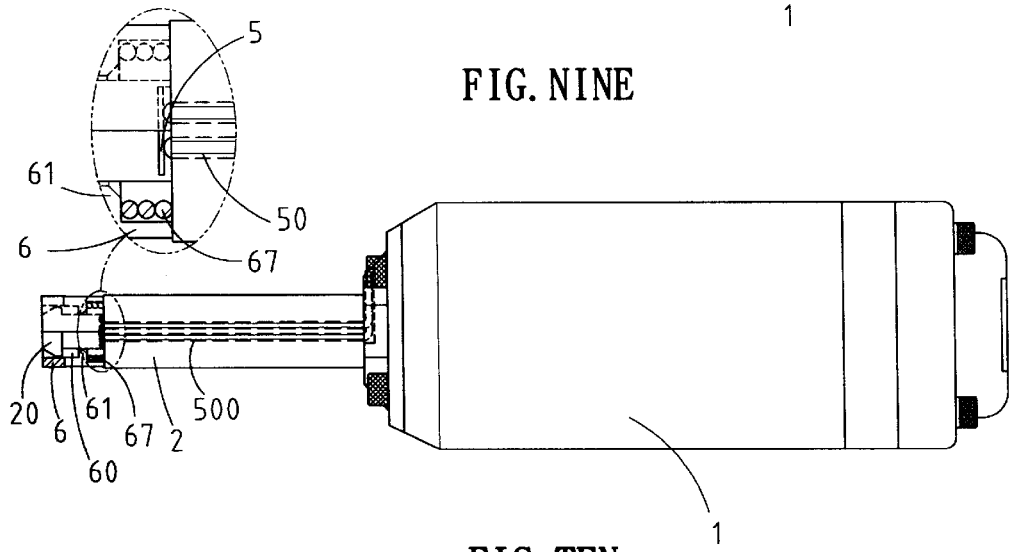
FIG. TEN

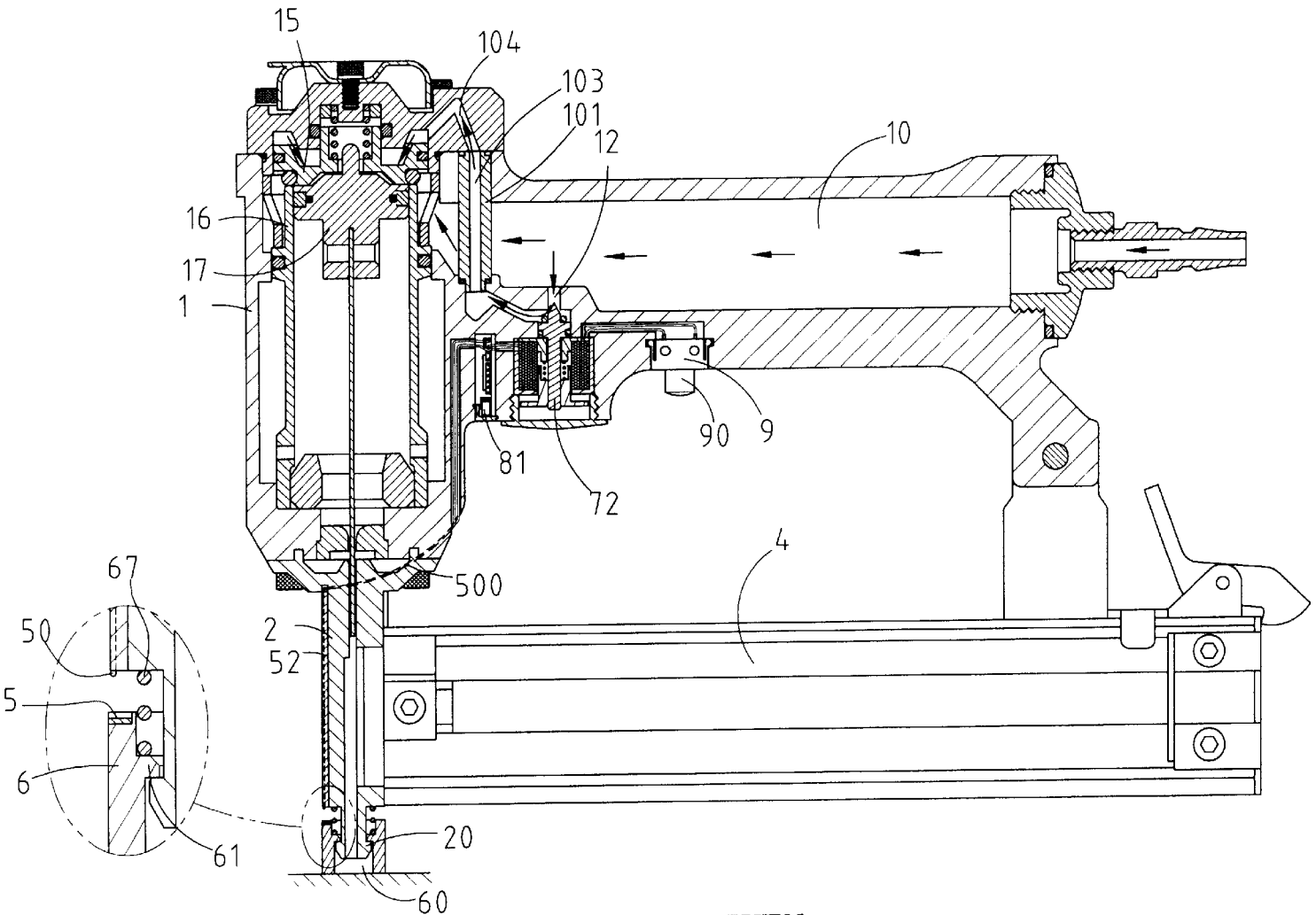
FIG. ELEVEN

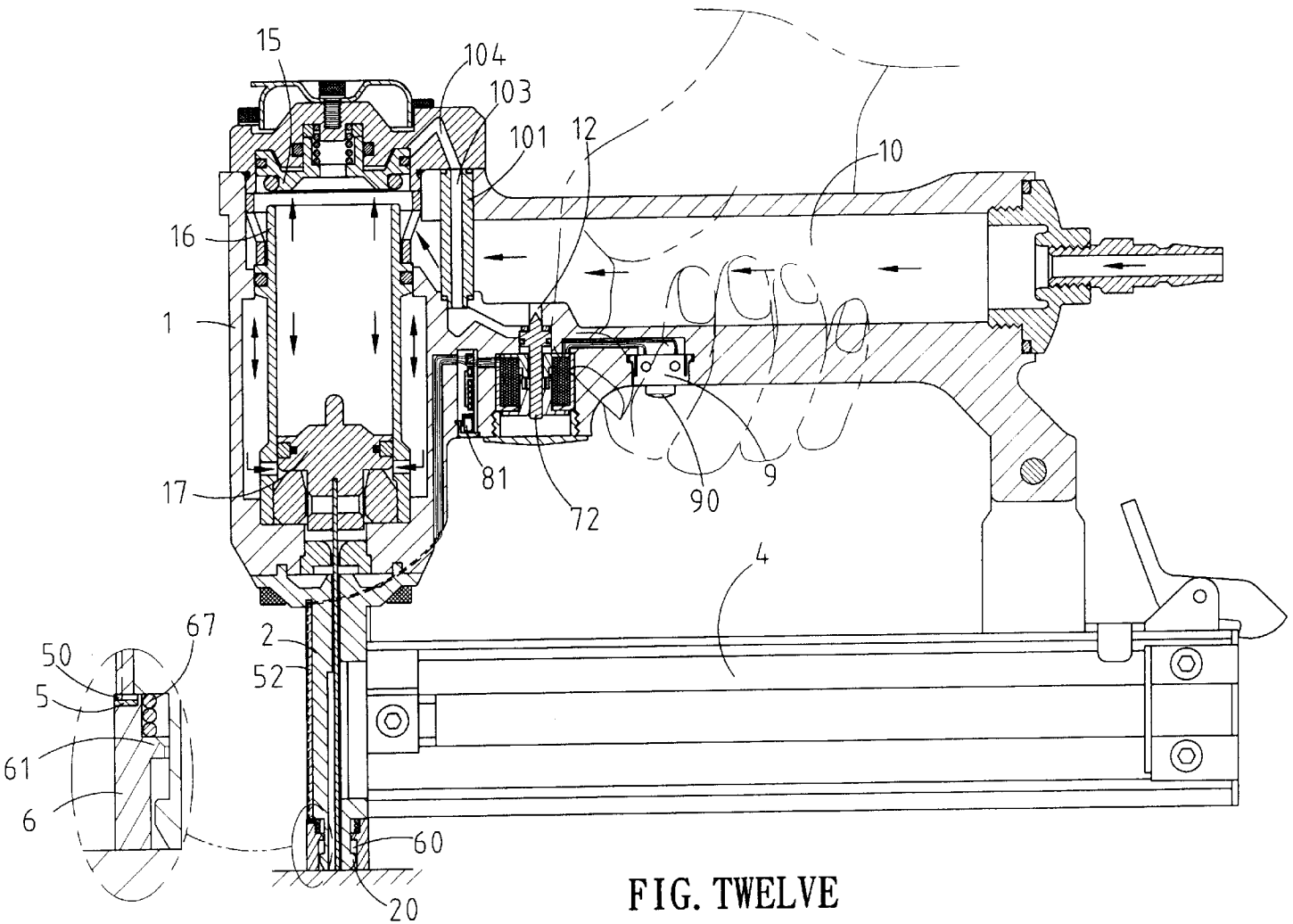
FIG. TWELVE

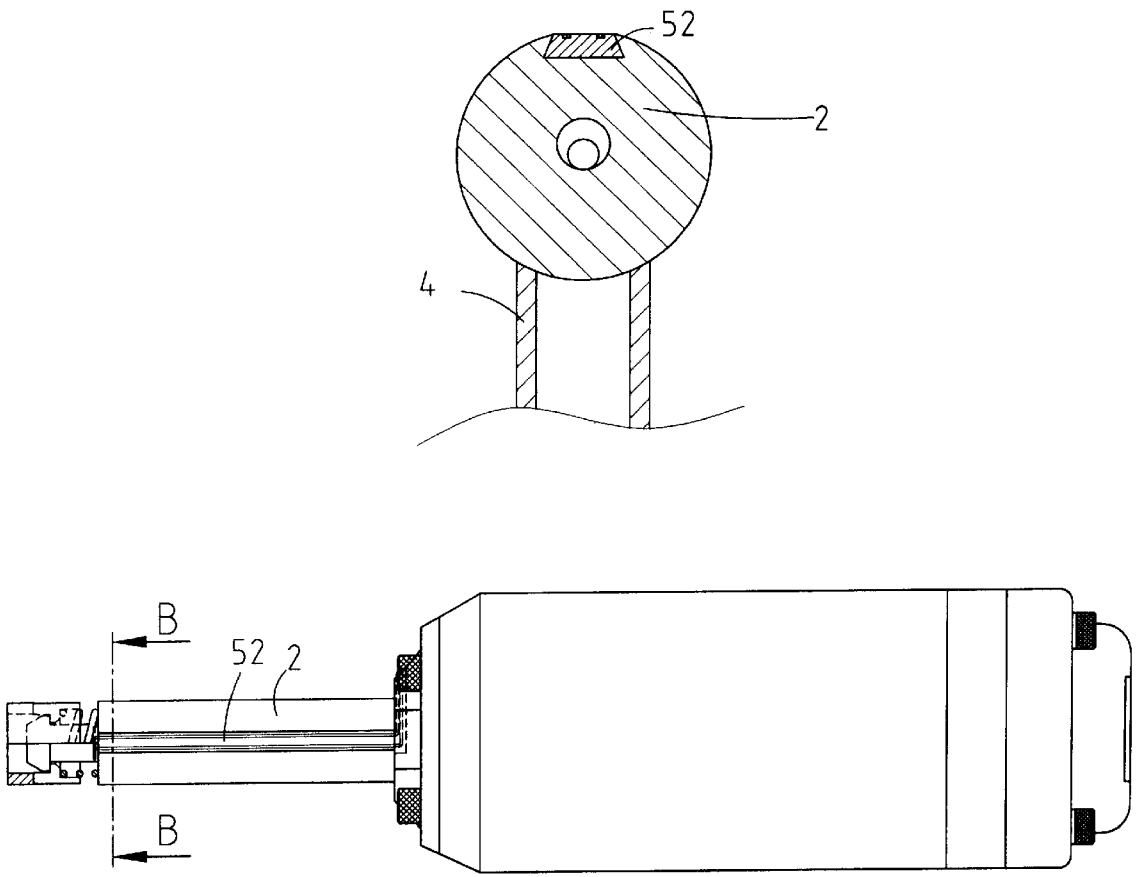
FIG. THIRTEEN

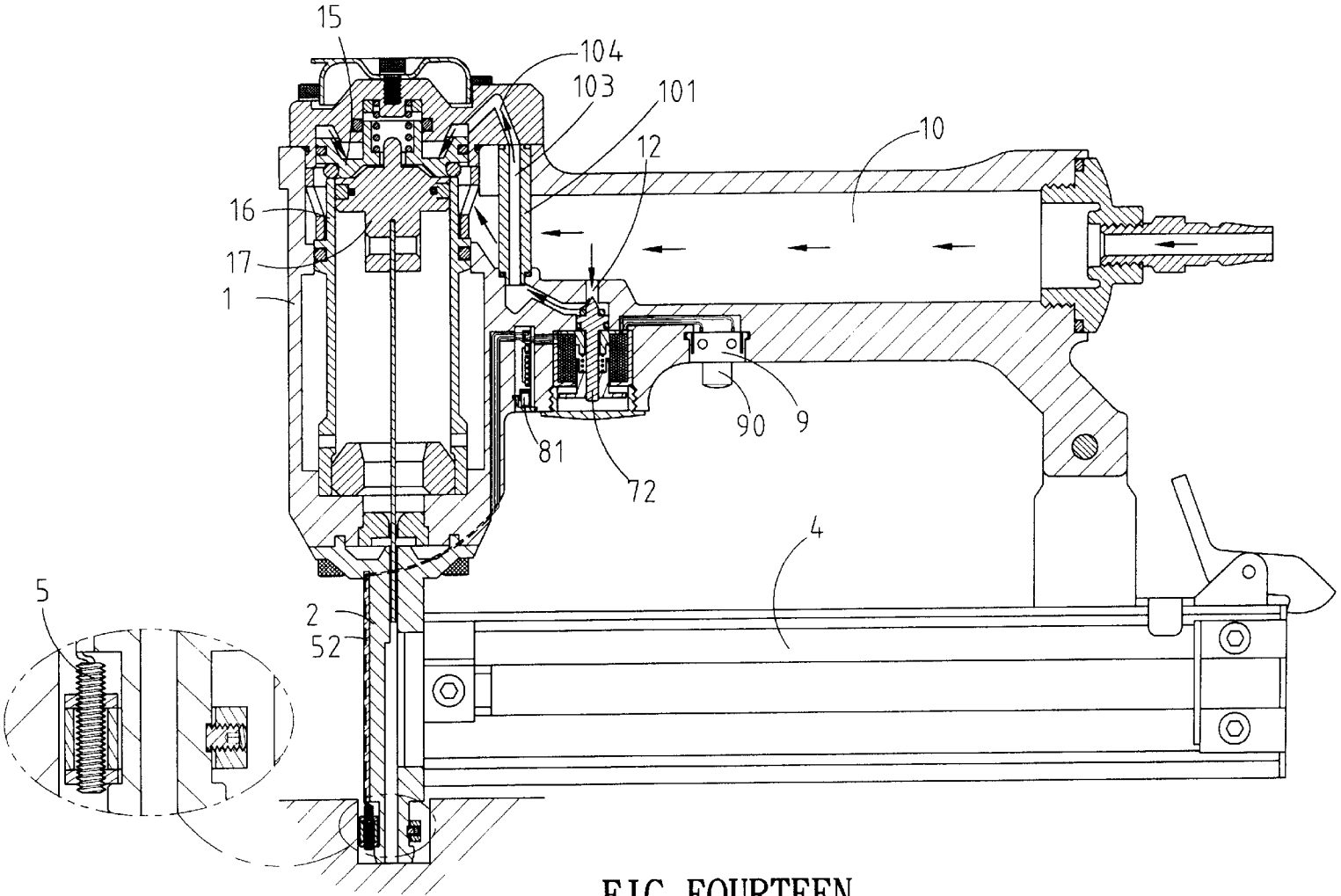
FIG. FOURTEEN

COMBINATION OF SAFETY ASSEMBLY AND TRIGGER ASSEMBLY FOR STAPLE GUNS

FIELD OF THE INVENTION

The present invention relates to a staple gun that includes a safety assembly electrically on a front end of the nose of the staple gun and connected to an electromagnetic valve which is cooperated with a trigger assembly.

A conventional staple gun is shown in FIG. 1 and generally includes a handle 1' with a main passage 11' which is connected to a source of air from a compressor (not shown) and a barrel is connected to the handle 1' with a chamber 10' defined in the barrel. A cylinder 24 is received in the barrel 10' and an end mount assembly 2' is connected to a rear end of the barrel and a nose is connected to a front end of the barrel. An end cap 22 is movably connected to an inside of the end mount assembly 2' and biased by a spring 22 so as to seal an open end of the cylinder 24 in which a piston 25 is movably received in the cylinder 24. A magazine for receiving staples is connected to the nose. A recess 12' is defined in a wall of the handle 1' and a trigger valve 4 is received in the recess and can be activated by a trigger 5'. Pressurized air may enter the recess 12' via a gap between the valve 4 and the opening in the wall of the handle 1' and enters a tube 3' engaged with a hole 14 defined in an inside of the handle 1 and a path 20'. The pressurized air enters a space between the end cap 22 and the end mount assembly 2' via the path 20' so that the opening of the cylinder 24 is sealed by the end cap 22 by the pressure in the space and the spring 21.

Referring to FIGS. 2 and 3, when a safety plate 55 is pushed toward the trigger 5' and the trigger 5' is squeezed, the shaft of the trigger valve 4 is shifted to seal the opening communicating with the recess 12' and the pressure in the space mentioned above is reduced so that the end cap 22 is pushed toward the end mount assembly 2' by the pressure in the main passage 11'. Once the end cap 22 is moved to open the open end of the cylinder 24, the piston 25 is moved to eject a staple by a plate connected to the piston 25 from the nose. Air in the cylinder 24 is pushed out via orifices defined through the wall of the cylinder 24 into the chamber 10'. Referring to FIG. 4, after shooting, the trigger 5' is released and the air in the chamber 10' enters the cylinder 24 again to push the piston 25 back to its original position. Simultaneously, air in the main passage 11' enters the tube 3' and the path 20' to assist the spring 21 to move the end cap 22 to seal the open end of the cylinder 24 again.

The safety plate 55 and the trigger 5' are exposed and protrude from the barrel of the staple gun so that they could be tangled by other object or activated unintentionally.

The present invention intends to provide a staple gun wherein the safety assembly is located at a distal end of the nose and connected to an electromagnetic valve so that the staple gun can be activated only when the safety assembly and the trigger both are operated.

SUMMARY OF THE INVENTION

In accordance with one aspect of the present invention, there is provided a staple gun which comprises a barrel and a cylinder is received in the barrel. A piston is movably received in the cylinder and a nose is connected to a front end of the barrel. A plate connected to the piston extends through the nose. An end mount assembly is connected to a rear end of the barrel and an end cap movably seals an open end of the cylinder and a spring is biased between the end cap and an inside of the end mount assembly.

A handle is connected to the barrel and a main passage is defined in the handle. The main passage communicates with a chamber in the barrel. A first opening and a second opening are respectively defined through a wall of the handle and respectively communicate with two recesses. A trigger valve and an electro-magnetic valve are respectively engaged with the two recesses. The trigger valve has a first shaft which movably seals the first opening and the elecro-magnetic valve has a second shaft which movably seals the second opening A trigger is connected to the first shaft so as to push the first shaft to seal the first opening.

A safety tube is movably mounted to a distal end of the nose and has a first sensor located at an end thereof A second sensor is located at nose and located corresponding to the first sensor. The second sensor is electrically connected to the electro-magnetic valve so as to move the second shaft to seal the second opening.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is a cross sectional view to show a conventional staple gun;

FIGS. 2 and 3 show the safety plate is pushed and the trigger is squeezed of the conventional staple gun;

FIG. 4 shows the piston is moved backward after the trigger of the conventional staple gun is released;

FIG. 5 is a cross sectional view to show the staple gun of the present invention;

FIG. 6 shows the second opening is sealed when the electromagnetic valve is activated;

FIG. 7 shows only the trigger is squeezed while the safety tube is not pushed;

FIG. 8 shows the safety tube is pushed and the trigger is activated to move the piston in the cylinder;

FIG. 9 shows that the safety tube is not yet pushed;

FIG. 10 shows that the safety tube is pushed;

FIG. 11 shows that the second sensor is replaced with a circuit board,

FIG. 12 shows that the safety tube is pushed wherein the second sensor is replaced with a circuit board;

FIG. 13 shows circuit board in the nose, and

FIG. 14 shows the safety tube and the sensors are replaced with an emitting member and a receiving member.

DETAILED DESCRIPTION OF THE PREFERRED EMBODIMENT

Referring to FIG. 5, the staple gun of the present invention comprises a barrel 1 with a chamber 100 defined therein and a cylinder 16 is received in the chamber 100. A piston 17 is movably received in the cylinder 16 and a plate is connected to the piston 17. A nose 2 is connected to a front end of the barrel 1 and the plate extends through the nose 2 such that when the piston 17 is moved a staple fed from the magazine 4 connected to the nose 2 is ejected by the plate. An end mount assembly is connected to a rear end of the barrel 1 and an end cap 15 movably seals an open end of the cylinder 16 by a spring biased between the end cap 15 and an inside of the end mount assembly.

A handle is connected to the barrel 1 and a main passage 10 is defined in the handle. A fitting is connected to the handle so as to be connected to a compressor which is not shown. The main passage 10 communicates with the chamber 100 in the barrel 1. A first opening 11 and a second opening 12 are respectively defined through a wall of the handle and respectively communicate with two recesses defined in an outside of the handle. A trigger valve 3 and an electromagnetic valve 7 are respectively engaged with the two recesses. The trigger valve 3 has a first shaft 30 which movably seals the first opening 11 when the trigger is squeezed, and the elecro-magnetic valve 7 has a second shaft 72 which movably seals the second opening 12 when the electromagnetic valve 7 is activated. A tube 101 is transversely received in the main passage 10. A first path 102 communicates with the two recesses, a second path 103 in the tube 101, a third path 104 defined in the end mount assembly, and a space defined between the end cap 16 and the end mount assembly. A trigger is connected to the first shaft 30 so as to push the first shaft 30 to seal the first opening 11 when squeezing the trigger. An electric power unit 8 is received in the outside of the handle to provide power to the electro-magnetic valve 7.

A safety tube 6 is movably mounted to a distal end of the nose 2, wherein the distal end of the nose 2 has a stop 20 extending outward from an outside thereof and the safety tube 6 has a flange 61 extending inward from an inside thereof. A spring 67 is biased between the flange 61 and the distal end of the nose 2 to bias the flange 61 on the stop 20. Further referring to FIG. 9, a first sensor 5 is located at an end of the safety tube 6 and a second sensor 50 is located at the distal end of the nose 2 and corresponding to the first sensor 5. The second sensor 50 is electrically connected to the electromagnetic valve 7 by a wire 500 so as to activate the electro-magnetic valve 7 to move the second shaft 72 to seal the second opening 12.

Referring to FIGS. 6 and 10, when pushing the safety tube 6 against an object to let the first sensor 5 and the second sensor 50 be in contact with each other, and the trigger is not pulled, although the second opening 12 is sealed by the second shaft 72, pressurized air still enters the first path 102 from the first opening 11. The end cap 15 cannot be moved because the sum of forces of the spring biasing the end cap 15 and the pressurized air in the space between the end cap 15 and the end mount assembly is larger than the force of the pressurized air applied on the end cap 15 in the direction to compress the spring biasing the end cap 15. Therefore, the staple gun cannot be activated.

Referring to FIG. 7, when the safety tube 6 is not pushed against an object and the first sensor 5 and the second sensor 50 are not in contact with each other, and the trigger is pulled. Although the first opening 11 is sealed by the first shaft 30, pressurized air still enters the first path 102 from the second opening 12. The end cap 15 cannot be moved because the sum of forces of the spring biasing the end cap 15 and the pressurized air in the space between the end cap 15 and the end mount assembly is larger than the force of the pressurized air applied on the end cap 15 in the direction to compress the spring biasing the end cap 15. Therefore, the staple gun cannot be activated.

Referring to FIG. 8, when the safety tube 6 is pushed to let the first sensor 5 and the second sensor 50 be in contact with each other, and the trigger is pulled, the pressurized air cannot enter the first path 102, the second path 103 and the third path 104. The force of the pressurized air in the main passage 10 pushes the spring biasing the end cap 15 which is shifted and pressurized air enters the cylinder 16 to push the piston 17 to eject a staple by the plate connected to the piston 17.

Referring to FIGS. 11 and 13, the second sensor 50 can be a circuit board and the handle has only one opening 12 which communicates with a recess in an outside of the handle. The electromagnetic valve is received in the recess. The trigger assembly is replaced with a button 90 and a valve 9 which is electrically connected to the electromagnetic valve. Referring to FIG. 12, when the safety tube 6 is pushed against an object to activate the electro-magnetic valve to move the shaft 72 to seal the opening 12, and the button 90 is pressed, the piston 17 is moved to eject a staple.

Referring to FIG. 14, the safety tube and the sensors are replaced with an emitting member and a receiving member. When the receiving member receives a signal from the emitting member to seal the opening 12 by the shaft 72, and the button 90 is pressed, the piston 17 is moved to eject a staple.

While we have shown and described the embodiment in accordance with the present invention, it should be clear to those skilled in the art that further embodiments may be made without departing from the scope of the present invention.

What is claimed is:

1. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly;

a handle connected to the barrel and a main passage defined in the handle, the main passage communicating with the chamber in the barrel, a first opening and a second opening respectively defined through a wall of the handle and respectively communicating with two recesses, a trigger valve and an electro-magnetic valve respectively engaged with the two recesses, the trigger valve having a first shaft which movably seals the first opening and the elecro-magnetic valve having a second shaft which movably seals the second opening, a tube transversely received in the main passage, a first path communicating with the two recesses, a second path in the tube, a third path defined in the end mount assembly, and a space defined between the end cap and the end mount assembly, a trigger connected to the first shaft so as to push the first shaft to seal the first opening, and a safety tube movably mounted to a distal end of the nose and having a first sensor located at an end thereof, a second sensor located at the distal end of the nose and corresponding to the first sensor, the second sensor electrically connected to the electro-magnetic valve so as to activate the electromagnetic valve to move the second shaft to seal the second opening.

2. The staple gun as claimed in claim 1, wherein the second sensor is a circuit board.

3. The staple gun as claimed in claim 1, wherein the first sensor and the second sensor are an emitting member and a receiving member respectively.

4. The staple gun as claimed in claim 1, wherein the distal end of the nose has a stop extending outward from an outside thereof and the safety tube has a flange extending inward from an inside thereof, a spring biased between the flange and the distal end of the nose to bias the flange on the stop.

5. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly;

a handle connected to the barrel and a main passage defined in the handle, the main passage communicating with the chamber in the barrel, an opening defined through a wall of the handle and communicating with a recess in an outside of the handle, an electro-magnetic valve engaged with the recess, a trigger connected to an outside of the handle and electrically connected to the electro-magnetic valve, the elecro-magnetic valve having a shaft which movably seals the opening, a tube transversely received in the main passage, a first path communicating with the recess, a second path in the tube, a third path defined in the end mount assembly, and a space defined between the end cap and the end mount assembly, and a safety tube movably mounted to a distal end of the nose and having a first sensor located at an end thereof, a second sensor located at the distal end of the nose and corresponding to the first sensor, the second sensor electrically connected to the electro-magnetic valve so as to activate the electro-magnetic valve.

6. The staple gun as claimed in claim 5, wherein the second sensor is a circuit board.

7. The staple gun as claimed in claim 5, wherein the first sensor and the second sensor are an emitting member and a receiving member respectively.

8. The staple gun as claimed in claim 5, wherein the distal end of the nose has a stop extending outward from an outside thereof and the safety tube has a flange extending inward from an inside thereof, a spring biased between the flange and the distal end of the nose to bias the flange on the stop.

* * * * *